US007021902B2

(12) United States Patent
Terauchi

(10) Patent No.: US 7,021,902 B2
(45) Date of Patent: Apr. 4, 2006

(54) HYBRID COMPRESSOR

(75) Inventor: Kiyoshi Terauchi, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/235,802

(22) Filed: Sep. 6, 2002

(65) Prior Publication Data

US 2003/0053916 A1 Mar. 20, 2003

(30) Foreign Application Priority Data

Sep. 14, 2001 (JP) ..... 2001-280630
Feb. 8, 2002 (JP) ..... 2002-031664

(51) Int. Cl.
*F01C 1/063* (2006.01)
*F04B 49/22* (2006.01)
*F04B 17/03* (2006.01)
*F04B 17/05* (2006.01)

(52) U.S. Cl. ..... 417/223; 417/280; 417/374; 417/410.5; 418/55.1; 418/60; 62/228.1

(58) Field of Classification Search ..... 417/410.5, 417/362.364, 374, 405, 323.1, 15, 16, 42, 417/34, 423.1, 223, 280, 287, 426, 427; 62/236, 62/228.4, 323.1, 323.4, 323.3, 230, 244, 62/228.2; 418/52.2, 55.3, 57, 60, 69, 55.1
See application file for complete search history.

(56) References Cited

U.S. PATENT DOCUMENTS

| | | | | |
|---|---|---|---|---|
| 4,277,955 | A * | 7/1981 | Parker | 62/510 |
| 4,591,318 | A * | 5/1986 | Elson | 417/312 |
| 4,729,717 | A * | 3/1988 | Gupta | 417/5 |
| 4,990,071 | A * | 2/1991 | Sugimoto | 418/5.2 |
| 5,295,808 | A * | 3/1994 | Machida et al. | 417/366 |
| 5,385,453 | A * | 1/1995 | Fogt et al. | 417/410.5 |
| 5,556,269 | A * | 9/1996 | Suzuki et al. | 418/5.2 |
| 5,558,508 | A * | 9/1996 | Sasano et al. | 417/569 |
| 5,755,564 | A * | 5/1998 | Machida et al. | 418/5.2 |
| 5,867,996 | A | 2/1999 | Takano et al. | 62/175 |
| 6,192,155 | B1 | 2/2001 | Fan | 382/232 |
| 6,217,297 | B1 | 4/2001 | Tsumagari et al. | 417/360 |
| 6,230,507 | B1 | 5/2001 | Ban et al. | 62/228.4 |
| 6,234,769 | B1 | 5/2001 | Sakai et al. | 417/374 |

(Continued)

FOREIGN PATENT DOCUMENTS

DE 19513710 10/1995

(Continued)

*Primary Examiner*—Charles G. Freay
(74) *Attorney, Agent, or Firm*—Baker Botts L.L.P.

(57) ABSTRACT

A hybrid compressor includes a first compression mechanism, which is driven by a first drive source, and a second compression mechanism, which is driven by a second drive source. A first discharge port of the first compression mechanism and a second discharge port of the second compression mechanism are connected to a single discharge path.

52 Claims, 1 Drawing Sheet

U.S. PATENT DOCUMENTS

| | | | | |
|---|---|---|---|---|
| 6,247,899 | B1 | 6/2001 | Ban et al. | 417/16 |
| 6,287,081 | B1 * | 9/2001 | Tamegai et al. | 417/15 |
| 6,287,083 | B1 * | 9/2001 | Hase et al. | 417/216 |
| 6,334,755 | B1 | 1/2002 | Coudray et al. | 415/115 |
| 6,375,436 | B1 * | 4/2002 | Irie et al. | 417/223 |
| 6,443,712 | B1 | 9/2002 | Sakai et al. | 417/374 |
| 6,543,243 | B1 * | 4/2003 | Mohrmann et al. | 62/230 |
| 2001/0047659 | A1 | 12/2001 | Nakamura et al. | |
| 2001/0049943 | A1 | 12/2001 | Nakamura et al. | |
| 2003/0136138 | A1 | 7/2003 | Tsuboi et al. | 62/228.1 |
| 2003/0152467 | A1 * | 8/2003 | Higashiyama et al. | 417/374 |
| 2004/0000156 | A1 | 1/2004 | Inoue et al. | |
| 2004/0001760 | A1 | 1/2004 | Yoshii et al. | |
| 2004/0020229 | A1 | 2/2004 | Adachi et al. | |

FOREIGN PATENT DOCUMENTS

| | | |
|---|---|---|
| EP | 1213166 | 6/2002 |
| JP | 687678 | 12/1994 |

* cited by examiner

HYBRID COMPRESSOR

BACKGROUND OF THE INVENTION

1. Field of the Invention

The present invention relates to a hybrid compressor for use in combined internal combustion and electric vehicles. In particular, the invention relates to a hybrid compressor which may be driven by an internal combustion engine or an electric motor.

2. Description of Related Art

A hybrid compressor capable of being driven by an internal combustion engine of a vehicle or an electric motor, or both, is described in Japanese Utility Model (Laid-Open) No. 6-87678. This hybrid compressor includes a clutch for the connection and disconnection of the compressor to an internal combustion engine of a vehicle and to an electric motor, and a single compression mechanism capable of being driven by the engine or the electric motor, or both.

Nevertheless, the hybrid compressor described in Japanese Utility Model (Laid-Open) No. 6-87678 is subject to several disadvantages. First, because a rotor of an electric motor is rotated when the engine is driven, the moment of inertia of a rotational portion is significant and an energy loss is significant. Second, in a case in which the electric motor is a DC brushless motor having a magnet, when the engine is driven, a rotational resistance loss is generated. This loss may be ascribed to the magnet. Third, in order to drive a compression mechanism, which is being driven by an engine, by an electric motor, a large-torque electric motor must be used, or the compression mechanism must be formed as a variable displacement-type mechanism which is capable of being driven even by a low-torque electric motor. Consequently, the size and complexity of the compressor increases. Fourth, when driven by an electric motor, such compressors experience significant energy loss and generate noise. Fifth, when driven by an electric motor, a drive shaft, which projects outside of the compressor's casing so that an engine also may drive the compressor also rotates or continues to rotate. When the drive shaft rotates, an energy is lost due to frictional resistance created by a shaft sealing device for the drive shaft, such as a lip seal, and the driving efficiency of the electric motor decreases. Sixth, because the same compression mechanism is driven by an engine and an electric motor, it is difficult or impossible to operate each drive source at a maximum efficiency.

SUMMARY OF THE INVENTION

Accordingly, it is an object of the present invention to provide an improved hybrid compressor which avoids the disadvantages of known compressors, as described above.

To achieve the foregoing and other objects, a hybrid compressor according to the present invention is provided The hybrid compressor comprises a first compression mechanism, which is driven exclusively by a first drive source, and a second compression mechanism which is driven by exclusively a second drive source. The first and second compression mechanisms are integrally formed in the compressor.

In the hybrid compressor according to the present invention, because the first compression mechanism is driven exclusively by the first drive source and the second compression mechanism is driven exclusively by the second drive source, the aforementioned disadvantages in known hybrid compressors are avoided. Further, by forming the first and second compression mechanisms integrally, the size of the hybrid compressor may be reduced.

In a preferred embodiment of the present invention, the first drive source is an internal combustion engine of a vehicle or an electric motor used for driving a vehicle, and the second drive source is an electric motor used for driving the compressor. When the hybrid compressor is mounted on a vehicle, an internal combustion engine of the vehicle or an electric motor may be used for driving the vehicle as the first drive source and an electric motor incorporated in the hybrid compressor or a separate electric motor dedicated exclusively to driving the hybrid compressor as the second drive source.

In another preferred embodiment of the present invention, a first discharge port is formed through a first end plate of the first compression mechanism, and a second discharge port is formed through a second end plate of the second compression mechanism. The discharge of the first compression mechanism and the discharge port of the second compression mechanism are connected to a single discharge path. Preferably, each of the first discharge port of the first compression mechanism and the second discharge port of the second compression mechanism is connected to the single discharge path via a check valve. The size of this hybrid compressor may be reduced by this configuration, wherein the first and second compression mechanisms have a common discharge path. Further, by providing the check valve, when one compression mechanism operates, the other compression mechanism does not supply refrigerant to the common discharge path. Thus, the discharged refrigerant from the one compression mechanism is prevented from flowing backward into the other compression mechanism.

In a further preferred embodiment of the present invention, a first displacement of the first compression mechanism is greater than a second displacement of the second compression mechanism. In a case in which the rotational output of the first drive source is greater than the rotational output of the second drive source, the first displacement of the first compression mechanism may be set greater than the second displacement of the second compression mechanism.

In still a further preferred embodiment of the present invention, each of the first and second compression mechanisms is a scroll-type compression mechanism. In this embodiment, preferably, a first fixed scroll of the first compression mechanism and a second fixed scroll of the second compression mechanism are disposed back to back. By this back-to-back construction, a single discharge path may be formed between the compression mechanisms. For example, the first and second fixed scrolls may extend from opposite surfaces of a shared end plate. The first and second discharge ports and the discharge path may be formed in the shared end plate.

In yet a further preferred embodiment of the present invention, the first fixed scroll of the first compression mechanism and the second fixed scroll of the second compression mechanism are integrally formed. In this embodiment, the number of parts for the compressor may be reduced.

In still yet a further preferred embodiment of the present invention, the first compression mechanism and the second compression mechanism are driven selectively or simultaneously. In other words, the first and second compression mechanisms may be driven at the same time, or the first compression mechanism may be driven when the second compression mechanism is stopped and vice versa.

In still yet a preferred embodiment of the present invention, a hybrid compressor comprises a first scroll-type compression mechanism, which is driven by a drive source comprising an internal combustion engine for driving a vehicle and an electric vehicle motor for driving the vehicle, and a second scroll-type compression mechanism, which is driven by an electric motor. The internal combustion engine and the electric vehicle motor alternatively may drive the first compression mechanism. The compressor further comprises a shared end plate having a first end plate surface and a second end plate surface. A first fixed scroll of the first scroll-type compression mechanism extends from the first end plate surface, and a second fixed scroll of the second scroll-type compression mechanism extends from the second end plate surface, such that the first fixed scroll is disposed opposite to the second fixed scroll. In addition, a first discharge port of the first compression mechanism and a second discharge port of the second compression mechanism are connected to a single discharge path. Each of the first discharge port of the first compression mechanism and the second discharge port of the second compression mechanism is connected to the discharge path via a check valve. Moreover, a first fluid displacement of the first compression mechanism is greater than a second fluid displacement of the second compression mechanism.

In still yet another preferred embodiment of the present invention, a hybrid compressor comprises a first scroll-type compression mechanism, which is driven by a drive source comprising an internal combustion engine for driving a vehicle and an electric vehicle motor for driving said vehicle, and a second scroll-type compression mechanism, which is driven by an electric motor. The internal combustion engine and the electric vehicle motor alternatively may drive the first compression mechanism. The compressor further comprises a first fixed scroll of the first scroll-type compression mechanism, which comprises a first end plate, and a second fixed scroll of the second scroll-type compression mechanism, which comprises a second end plate. The first fixed scroll and the second fixed scroll are integrally formed. In addition, a first discharge port of the first compression mechanism and a second discharge port of the second compression mechanism are connected to a single discharge path. Each of the first discharge port of the first compression mechanism and the second discharge port of the second compression mechanism is connected to the discharge path via a check valve. Moreover, a first fluid displacement of the first compression mechanism is greater than a second fluid displacement of the second compression mechanism.

Thus, in the hybrid compressor according to the present invention, because the first compression mechanism is driven exclusively by the first drive source and the second compression mechanism is driven exclusively by the second drive source, the aforementioned disadvantages in known hybrid compressors are avoided, improved compressor efficiency may be obtained. Further, by the integral formation of the first and second compression mechanisms, the size of the hybrid compressor may be reduced.

Further objects, features, and advantages of the present invention will be understood from the following detailed description of a preferred embodiment of the present invention with reference to the accompanying FIGURE.

BRIEF DESCRIPTION OF THE DRAWINGS

An embodiment of the invention is now described with reference to the accompanying FIGURE, which is given by way of example only, and is not intended to limit the present invention.

DETAILED DESCRIPTION OF PREFERRED EMBODIMENTS

Figure 1:
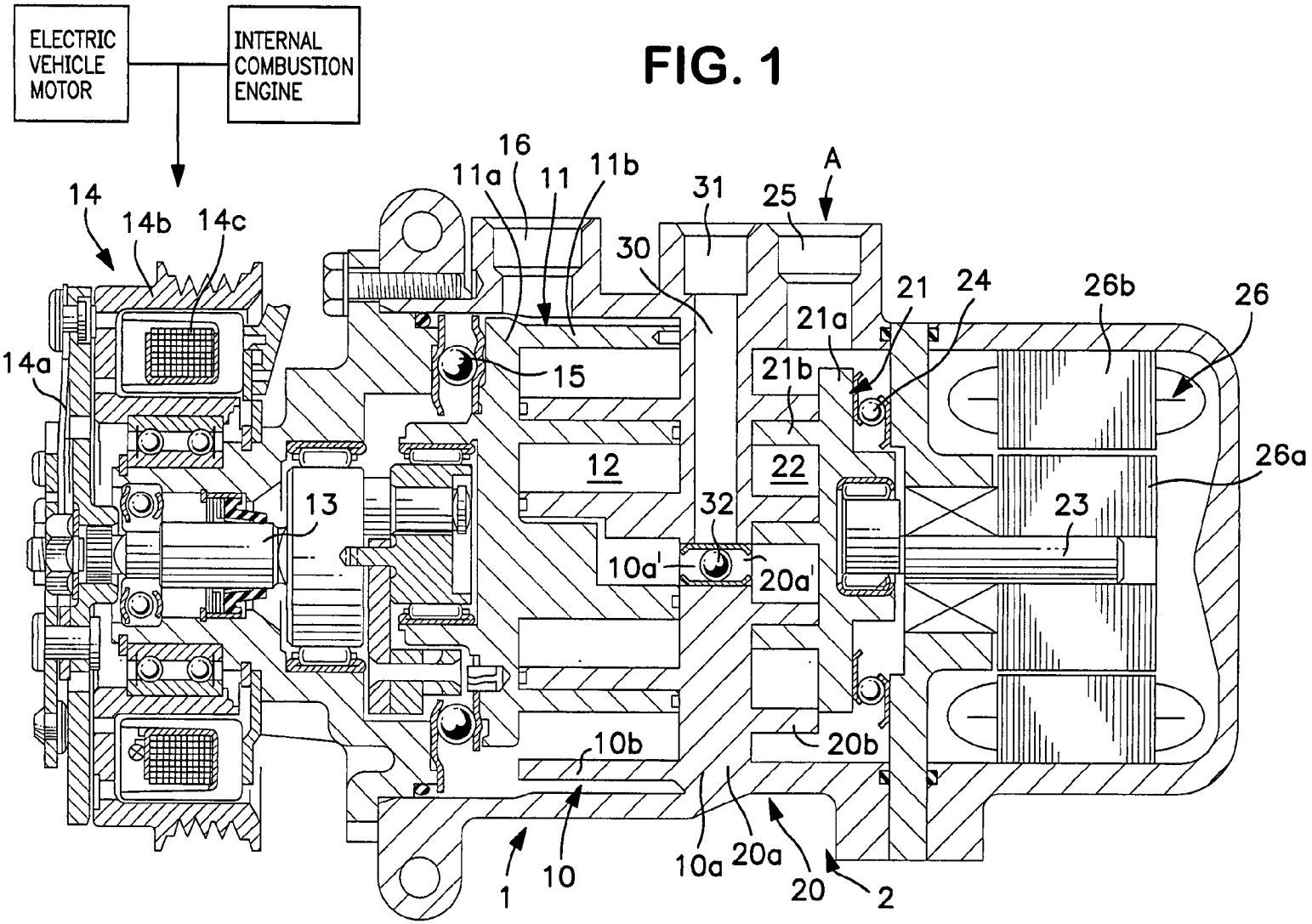
FIG. 1 is a vertical, cross-sectional view of a hybrid compressor according to an embodiment of the present invention.

A hybrid compressor according to an embodiment of the present invention is depicted in FIG. 1. Referring to FIG. 1, hybrid compressor A has a first compression mechanism 1 and a second compression mechanism 2. Hybrid compressor A is used, for example, in a refrigerant cycle of an air conditioning system mounted in a vehicle.

First compression mechanism 1 comprises a first fixed scroll 10 having a first fixed end plate 10*a* and a first fixed spiral element 10*b*, an first orbital scroll 11 having a first orbital end plate 11*a*, and a first orbital spiral element 11*b*. First fixed scroll 10 and first orbital scroll 11 engage to form a first plurality of pairs of fluid pockets 12. First compression mechanism 1 also comprises a drive shaft 13, which engages first orbital scroll 11 and provides an orbital movement to orbital scroll 11, and an electromagnetic clutch 14. Electromagnetic clutch 14 comprises a clutch armature 14*a* fixed to first drive shaft 13, a pulley 14*b* connected to an engine or electric motor (not shown) of a vehicle via a belt (not shown), and an electromagnet 14*c* for connecting and disconnecting clutch armature 14*a* and pulley 14*b*. Further, first compression mechanism 1 comprises a first rotation prevention device 15 for preventing the rotation of first orbital scroll 11, and a first inlet port 16 formed through a casing. A first discharge port 10*a*' is formed through a first surface of first end plate 10*a* of first fixed scroll 10. The engine of a vehicle for use in driving first compression mechanism 1 may include either an internal combustion engine or an electric motor for driving a vehicle.

Second compression mechanism 2 comprises a second fixed scroll 20 having a second fixed end plate 20*a* and a second fixed spiral element 20*b*, a second orbital scroll 21 having a second orbital end plate 21*a* and a second orbital spiral element 21*b*. Second fixed scroll 20 and second orbital scroll 21 engage to form a second plurality of pairs of fluid pockets 22, second compression mechanism 2 also comprises a second drive shaft 23 engaging, which engages second orbital scroll 21 and provides an orbital movement to second orbital scroll 21, a second rotation prevention device 24 for preventing the rotation of second orbital scroll 21, and a second inlet port 25 formed through the casing. A second discharge port 20*a*' is formed through a second surface of second end plate 20*a* of second fixed scroll 20. An electric motor 26 is provided for driving second drive shaft 23 of second compression mechanism 2. Electric motor 26 has a rotor 26*a* which is fixed to second drive shaft 23 and a stator 26*b*.

First fixed scroll 10 of first compression mechanism 1 and second fixed scroll 20 of second compression mechanism 2 are disposed back-to-back, and the fixed scrolls are formed integrally. Thus, together, end plates 10*a* and 20*a* form a shared end plate. A discharge path 30 is formed between end plates 10*a* and 20*a* and within the shared end plate. An outlet port 31 is formed at a downstream end of discharge path 30. First discharge port 10*a*' formed through first end plate 10*a* of first compression mechanism 1 and second discharge port 20*a*' formed through second end plate 20*a* of second compression mechanism 2 are connected to an upstream end of discharge path 30 via a check valve 32. First compression mechanism 1 and second compression mechanism 2, thus configured, are formed integrally in hybrid compressor A.

When hybrid compressor A is driven by an engine, electromagnetic clutch 14 is activated, the rotational output of the engine is transmitted to first drive shaft 13 of first compression mechanism 1 via clutch armature 14*a*, and first orbital scroll 11 is driven in its orbital movement by first drive shaft 13. Refrigerant introduced from first inlet port 16 flows into fluid pockets 12. Fluid pockets 12 move toward the center of first fixed scroll 10 while being reduced in volume, whereby the refrigerant in fluid pockets 12 is compressed. The compressed refrigerant is discharged to discharge path 30 through first discharge port 10*a*' formed through the first end surface of first end plate 10*a* of fixed scroll 10 via check valve 32. The discharged then flows out to a high pressure side of an external refrigerant circuit through outlet port 31.

In this condition, an electric power need not be, and generally is not, supplied to electric motor 26 provided for driving second compression mechanism 2, and, consequently, electric motor 26 does not rotate. Therefore, second compression mechanism 2 does not operate. Because second discharge port 20*a*' of second compression mechanism 2 is closed by check valve 32, the refrigerant discharged from first compression mechanism 1 does not flow backward into second compression mechanism 2.

When hybrid compressor A is driven by electric motor 26, electric motor 26 is activated, the rotational output of the electric motor 26 is transmitted to second drive shaft 23 of second compression mechanism 2, and second orbital scroll 21 is driven in its orbital movement by second drive shaft 23. Refrigerant introduced from second inlet port 25 flows into fluid pockets 22. Fluid pockets 22 move toward the center of second fixed scroll 20 while being reduced in volume, whereby the refrigerant in fluid pockets 22 is compressed. The compressed refrigerant is discharged to discharge path 30 through second discharge port 20*a*' formed through the second end surface of second end plate 20*a* of second fixed scroll 20 via check valve 32, and the discharged refrigerant then flows out to a high pressure side of an external refrigerant circuit through outlet port 31.

In this configuration, electric power is not supplied to electromagnetic clutch 14 of first compression mechanism 1, and the rotational output of the engine of a vehicle is not transmitted to first compression mechanism 1. Therefore, first compression mechanism 1 does not operate. Because first discharge port 10*a*' of first compression mechanism 1 is closed by check valve 32, the refrigerant discharged from second compression mechanism 2 does not flow backward into first compression mechanism 1.

In such a hybrid compressor A, because first compression mechanism 1 is driven exclusively by the engine of a vehicle, which is a first drive source, and because second compression mechanism 2 is driven exclusively by electric motor 26, which is a second drive source different from the first drive source, the following advantages may be obtained. First, because rotor 26*a* of electric motor 26 is not rotated when compressor A is driven by the engine, the moment of inertia of the rotating portion is reduced, and an energy loss by compressor A also is reduced. Second, even if electric motor 26 is a DC brushless motor having a magnet, when driven by the engine, a rotational resistance loss due to the magnet is reduced or eliminated. Third, because electric motor 26 does not drive first compression mechanism 1, if the displacement of second compression mechanism 2 is set to be low as compared with that of first compression mechanism 1, it may not be necessary to employ a large-torque motor as electric motor 26. Moreover, it may not be necessary to form second compression mechanism 2 as a variable displacement-type compression mechanism. Therefore, the size and complexity of compressor A may be further reduced. The displacement of first compression mechanism 1 may be increased or maximized, because first compression mechanism 1 is driven by an engine. Fourth, when second compression mechanism 2 is driven by electric motor 26, because clutch armature 14*a* does not rotate, energy loss and noise are reduced or eliminated. Fifth, when second compression mechanism 2 is driven by electric motor 26, the energy loss due to the friction resistance of a shaft sealing device is reduced or eliminated, but the driving efficiency of electric motor 26 does not decline, because first drive shaft 13, which projects outside of the compressor casing and is driven by an engine does not rotate. Sixth, because first compression mechanism 1 is driven by an engine and second compression mechanism 2 is driven by electric motor 26, each driving device may be operated at its maximum efficiency when the respective compression mechanism is driven, thereby increasing or maximizing energy savings at improved performance levels. Seventh, because first compression mechanism 1 and second compression mechanism 2 may be driven simultaneously, a large displacement may be obtained, as needed. This increases the flexibility of the refrigerant circuit.

Further, the size of hybrid compressor A may be formed further reduced by integrally forming first compression mechanism 1 and second compression mechanism 2. Moreover, the size of hybrid compressor A may be further reduced by providing a single discharge path 30 for common use by first compression mechanism 1 and second compression mechanism 2. By disposing check valve 32, in common discharge path 30 the refrigerant discharged from one compression mechanism during its operation is prevented from flowing backward into the other, stopped compression mechanism.

In addition, because first fixed scroll 10 of first compression mechanism 1 and second fixed scroll 20 of second compression mechanism 2 are disposed back-to-back, single discharge path 30 may be formed therebetween, thereby further reducing the size of hybrid compressor A. Moreover, the number of parts is decreased by integrally forming first fixed scroll 10 of first compression mechanism 1 and second fixed scroll 20 of second compression mechanism 2.

In the above-described embodiment, first compression mechanism 1 and second compression mechanism 2 may be simultaneously driven. First discharge port 10*a*' may be connected to discharge path 30 via a known first discharge valve, e.g., a reed valve, and second discharge port 20*a*' also may be connected to discharge path 30 via a known second discharge valve. First compression mechanism 1 and second compression mechanism 2 may have respective discharge valves and outlet ports independent from each other. First compression mechanism 1 and second compression mechanism 2 may be constructed, so that refrigerant is drawn through a common inlet port.

First drive shaft 13 of first compression mechanism 1 and second drive shaft 23 of second compression mechanism 2 may be aligned on the axis, and may be disposed on different axes. The relative positional relationship between first compression mechanism 1 and second compression mechanism 2 is not limited to a back-to-back state, as depicted in FIG. 1. The relative positional relationship may be appropriately optimized, as needed. For example, the hybrid compressor may be configured, as needed, to fit within the vehicle engine compartment.

The combination of first compression mechanism 1 and second compression mechanism 2 is not limited to a combination of scroll-types compression mechanisms. For example, a combination of inclined plate-type compression mechanisms, a combination of an inclined plate-type compression mechanism and a scroll-type compression mechanism, a combination of vane-type compression mechanisms, a combination of an inclined plate-type compression mechanism and a vane-type compression mechanism, and a combination of a scroll-type compression mechanism and a vane-type compression mechanism may be employed, and a combination of these and other types of compression mechanisms may be employed.

Second compression mechanism 2 may be driven by an electric motor provided separately from compressor A, which is different from electric motor 26. Further, the first drive source connected to first compression mechanism 1 may consist of any engine of a vehicle (including an internal combustion engine and an electric motor for driving a vehicle) and an electric motor mounted on a vehicle for any purpose, except for driving the vehicle, and the first compression mechanism 1 may be driven by both the engine and the electric motor, or by a selected drive source switched between these two drive sources.

Although preferred embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A hybrid compressor comprising:

a first compression mechanism, which is driven by a first drive source; and a second compression mechanism, which is driven by a second drive source, wherein a first discharge port of said first compression mechanism and a second discharge port of said second compression mechanism are connected to a single discharge path, wherein said first drive source comprises an internal combustion engine for driving a vehicle and an electric vehicle motor for driving said vehicle, wherein said internal combustion engine and said electric vehicle motor alternatively drive said first compression mechanism, and said second drive source comprises an electric motor, wherein each of said first and second compression mechanisms is a scroll-type compression mechanism and wherein said hybrid compressor comprises a shared end plate having a first end plate surface and a second end plate surface, wherein a first fixed scroll of said first compression mechanism extends from said first end plate surface and a second fixed scroll of said second compression mechanism extends from said second end plate surface, such that said first fixed scroll is disposed opposite to said second fixed scroll.

2. The hybrid compressor according to claim 1, wherein each of said first discharge port of said first compression mechanism and said second discharge port of said second compression mechanism is connected to said discharge path via a check valve.

3. The hybrid compressor according to claim 1, wherein a first fluid displacement of said first compression mechanism is greater than a second fluid displacement of said second compression mechanism.

4. The hybrid compressor according to claim 1, wherein said first compression mechanism and said second compression mechanism are driven simultaneously.

5. The hybrid compressor according to claim 1, wherein said first compression mechanism and said second compression mechanism are driven selectively.

6. A hybrid compressor comprising:

a first scroll-type compression mechanism, which is driven by a drive source comprising an internal combustion engine for driving a vehicle and an electric vehicle motor for driving said vehicle, wherein said internal combustion engine and said electric vehicle motor alternatively drive said first compression mechanism;

a second scroll-type compression mechanism, which is driven by an electric motor; and a shared end plate having a first end plate surface and a second end plate surface and wherein a first fixed scroll of said first scroll-type compression mechanism extends from said first end plate surface and a second fixed scroll of said second scroll-type compression mechanism extends from said second end plate surface, such that said first fixed scroll is disposed opposite to said second fixed scroll, wherein a first discharge port of said first compression mechanism and a second discharge port of said second compression mechanism are connected to a single discharge path, wherein each of said first discharge port of said first compression mechanism and said second discharge port of said second compression mechanism is connected to said discharge path via a check valve, and wherein a first fluid displacement of said first compression mechanism is greater than a second fluid displacement of said second compression mechanism.

7. The hybrid compressor according to claim 6, wherein said first compression mechanism and said second compression mechanism are driven simultaneously.

8. The hybrid compressor according to claim 7, wherein said first compression mechanism and said second compression mechanism are driven selectively.

9. A hybrid compressor comprising:

a first compression mechanism, which is driven by a first drive source; and a second compression mechanism, which is driven by a second drive source, wherein a first discharge port of said first compression mechanism and a second discharge port of said second compression mechanism are connected to a single discharge path, wherein said first drive source comprises an internal combustion engine for driving a vehicle and an electric vehicle motor for driving said vehicle, wherein said internal combustion engine and said electric vehicle motor alternatively drive said first compression mechanism, and said second drive source comprises an electric motor, wherein each of said first and second compression mechanisms is a scroll-type compression mechanism and further comprising a first fixed scroll comprising a first end plate, and a second fixed scroll comprising a second end plate, and wherein said first fixed scroll of said first compression mechanism and said second fixed scroll of said second compression mechanism are integrally formed.

10. A hybrid compressor comprising:

a first scroll-type compression mechanism, which is driven by a drive source comprising an internal combustion engine for driving a vehicle and an electric vehicle motor for driving said vehicle, wherein said internal combustion engine and said electric vehicle motor alternatively drive said first compression mechanism;

a second scroll-type compression mechanism, which is driven by an electric motor; and a first fixed scroll of said first scroll-type compression mechanism comprising a first end plate, and a second fixed scroll of said second scroll-type compression mechanism comprising a second end plate, wherein said first fixed scroll and said second fixed scroll are integrally formed, wherein a first discharge port of said first compression mechanism and a second discharge port of said second compression mechanism are connected to a single discharge path, wherein each of said first discharge port of said first compression mechanism and said second discharge port of said second compression mechanism is connected to said discharge path via a check valve, and wherein a first fluid displacement of said first compression mechanism is greater than a second fluid displacement of said second compression mechanism.

11. The hybrid compressor according to claim 10, wherein said first compression mechanism and said second compression mechanism are driven simultaneously.

12. The hybrid compressor according to claim 10, wherein said first compression mechanism and said second compression mechanism are driven selectively.

13. A hybrid compressor comprising:

a first compression mechanism comprising a first discharge port, wherein the first compression mechanism is driven by a first drive source;

a second compression mechanism comprising a second discharge port, wherein the second compression mechanism is driven by a second drive source; and means for preventing each of:

a first fluid discharged from the first compression mechanism from entering the second compression mechanism; and a second fluid discharged from the second compression mechanism from entering the first compression mechanism;

wherein the hybrid compressor comprises a shared end plate having a first end plate surface and a second end plate surface, wherein the first compression mechanism extends from the first end plate surface and the second compression mechanism extends from the second end plate surface, such that the first compression mechanism is disposed opposite to the second compression mechanism.

14. The hybrid compressor of claim 13, wherein the means for preventing comprises at least one valve positioned between the first discharge port and the second discharge port.

15. The hybrid compressor of claim 14, wherein the at least one valve comprises a check valve.

16. The hybrid compressor of claim 15, wherein the first compression mechanism and the second compression mechanism are driven simultaneously.

17. The hybrid compressor of claim 14, wherein the at least one valve comprises:

a first valve connected to the first compression mechanism; and a second valve connected to the second compression mechanism.

18. The hybrid compressor of claim 17, wherein the first valve comprises a first reed valve, and the second valve comprises a second reed valve.

19. The hybrid compressor of claim 17, wherein the first compression mechanism and the second compression mechanism are driven simultaneously.

20. The hybrid compressor of claim 13, wherein the first discharge port and the second discharge port are in fluid communication with a single discharge path.

21. The hybrid compressor of claim 13, wherein the first discharge port is in fluid communication with a first discharge path and the second discharge port is in fluid communication with a second discharge path.

22. The hybrid compressor of claim 13, wherein the first compression mechanism comprises a first inlet port for receiving the first fluid, and the first inlet port is in fluid communication with the first discharge port, and wherein the second compression mechanism comprises a second inlet port for receiving the second fluid, and the second inlet port is in fluid communication with the second discharge port.

23. The hybrid compressor of claim 13, further comprising an inlet port for receiving the first fluid and the second fluid, wherein the first inlet port is in fluid communication with the first discharge port and the second discharge port.

24. The hybrid compressor according to claim 13, wherein the first drive source comprises an internal combustion engine for driving a vehicle and an electric vehicle motor for driving the vehicle, wherein the internal combustion engine and the electric vehicle motor alternatively drive the first compression mechanism, and the second drive source comprises an electric motor.

25. The hybrid compressor according to claim 13, wherein a first fluid displacement of the first compression mechanism is greater than a second fluid displacement of the second compression mechanism.

26. A hybrid compressor comprising:

a first compression mechanism comprising a first discharge port, wherein the first compression mechanism is driven by a first drive source;

a second compression mechanism comprising a second discharge port, wherein the second compression mechanism is driven by a second drive source; and means for preventing each of:

a first fluid discharged from the first compression mechanism from entering the second compression mechanism; and a second fluid discharged from the second compression mechanism from entering the first compression mechanism; wherein the first compression mechanism and the second compression mechanism are driven selectively, and wherein when the first drive source drives the first compression mechanism the check valve closes the second discharge port, and when the second drive source drives the second compression mechanism the check valve closes the first discharge port; wherein the means for preventing comprises at least one valve positioned between the first discharge port and the second discharge port; and wherein the at least one valve comprises a check valve.

27. A hybrid compressor comprising:

a first compression mechanism comprising a first discharge port, wherein the first compression mechanism is driven by a first drive source;

a second compression mechanism comprising a second discharge port, wherein the second compression mechanism is driven by a second drive source; and means for preventing each of:

a first fluid discharged from the first compression mechanism from entering the second compression mechanism; and a second fluid discharged from the second compression mechanism from entering the first compression mechanism;

wherein the means for preventing comprises at least one valve positioned between the first discharge port and the second discharge port; wherein the at least one valve comprises:

a first valve connected to the first compression mechanism; and a second valve connected to the second compression mechanism; and wherein the first compression mechanism and the second compression mechanism are driven selectively, and wherein when the first drive source drives the first compression mechanism the second valve closes the second discharge port, and when the second drive source drives the second compression mechanism the first valve closes the first discharge port.

28. A hybrid compressor comprising:

a first compression mechanism comprising a first discharge port, wherein the first compression mechanism is driven by a first drive source;

a second compression mechanism comprising a second discharge port, wherein the second compression mechanism is driven by a second drive source; and means for preventing each of:

a first fluid discharged from the first compression mechanism from entering the second compression mechanism; and a second fluid discharged from the second compression mechanism from entering the first compression mechanism; wherein the first compression mechanism comprises a first end plate and the second compression mechanism comprises a second end plate, and wherein the first compression mechanism and the second compression mechanism are formed integrally.

29. A hybrid compressor comprising:

a first scroll-type compression mechanism, which is driven by a first drive source;

a second scroll-type compression mechanism, which is driven by a second drive source, wherein a first discharge port of said first scroll-type compression mechanism and a second discharge port of said second scroll-type compression mechanism are connected to a single discharge path; and a shared end plate having a first end plate surface and a second end plate surface, wherein a first fixed scroll of said first scroll-type compression mechanism extends from said first end plate surface and a second fixed scroll of said second scroll-type compression mechanism extends from said second end plate surface, such that said first fixed scroll is disposed opposite to said second fixed scroll.

30. The hybrid compressor according to claim 29, wherein said first drive source comprises an internal combustion engine for driving a vehicle and an electric vehicle motor for driving said vehicle, wherein said internal combustion engine and said electric vehicle motor alternatively drive said first scroll-type compression mechanism, and said second drive source comprises an electric motor.

31. The hybrid compressor according to claim 29, wherein each of said first discharge port of said first scroll-type compression mechanism and said second discharge port of said second scroll-type compression mechanism is connected to said discharge path via a check valve.

32. The hybrid compressor according to claim 29, wherein a first fluid displacement of said first scroll-type compression mechanism is greater than a second fluid displacement of said second scroll-type compression mechanism.

33. The hybrid compressor according to claim 29, wherein said first scroll-type compression mechanism and said second scroll-type compression mechanism are driven selectively.

34. The hybrid compressor according to claim 29, wherein said first scroll-type compression mechanism and said second scroll-type compression mechanism are driven simultaneously.

35. A hybrid compressor comprising:

a first scroll-type compression mechanism, which is driven by a first drive source, wherein said first scroll-type compression mechanism comprises a first fixed scroll comprising a first end plate; and a second scroll-type compression mechanism, which is driven by a second drive source, wherein said second scroll-type compression mechanism comprises a second fixed scroll comprising a second end plate, wherein said first fixed scroll and said second fixed scroll are integrally formed, wherein a first discharge port of said first scroll-type compression mechanism and a second discharge port of said second scroll-type compression mechanism are connected to a single discharge path.

36. The hybrid compressor according to claim 35, wherein said first drive source comprises an internal combustion engine for driving a vehicle and an electric vehicle motor for driving said vehicle, wherein said internal combustion engine and said electric vehicle motor alternatively drive said first scroll-type compression mechanism, and said second drive source comprises an electric motor.

37. The hybrid compressor according to claim 35, wherein each of said first discharge port of said first scroll-type compression mechanism and said second discharge port of said second scroll-type compression mechanism is connected to said discharge path via a check valve.

38. The hybrid compressor according to claim 35, wherein a first fluid displacement of said first scroll-type compression mechanism is greater than a second fluid displacement of said second scroll-type compression mechanism.

39. The hybrid compressor according to claim 35, wherein said first scroll-type compression mechanism and said second scroll-type compression mechanism are driven selectively.

40. The hybrid compressor according to claim 35, wherein said first scroll-type compression mechanism and said second scroll-type compression mechanism are driven simultaneously.

41. A hybrid compressor comprising:

a first compression mechanism, which is driven by a first drive source;

a second compression mechanism, which is driven by a second drive source, wherein a first discharge port of said first compression mechanism and a second discharge port of said second compression mechanism are connected to a single discharge path; and a shared, fixed end plate having a first end plate surface and a second end plate surface, wherein said first compression mechanism extends from said first end plate surface and said second compression mechanism extends from said second end plate surface, such that said first compression mechanism is disposed opposite to said second compression mechanism.

42. The hybrid compressor according to claim 41, wherein said first drive source comprises an internal combustion engine for driving a vehicle and an electric vehicle motor for driving said vehicle, wherein said internal combustion engine and said electric vehicle motor alternatively drive said first compression mechanism, and said second drive source comprises an electric motor.

43. The hybrid compressor according to claim 41, wherein each of said first discharge port of said first compression mechanism and said second discharge port of said second compression mechanism is connected to said discharge path via a check valve.

44. The hybrid compressor according to claim 41, wherein a first fluid displacement of said first compression mechanism is greater than a second fluid displacement of said second compression mechanism.

45. The hybrid compressor according to claim 41, wherein said first compression mechanism and said second compression mechanism are driven selectively.

46. The hybrid compressor according to claim 41, wherein said first compression mechanism and said second compression mechanism are driven simultaneously.

47. A hybrid compressor comprising:

a first compression mechanism, which is driven by a first drive source, wherein said first drive source comprised an internal combustion engine for driving a vehicle and an electric vehicle motor for driving said vehicle and wherein said first compression mechanism comprises a first end plate; and a second compression mechanism, which is driven by a second drive source, wherein said second compression mechanism comprises a second end plate, wherein said first compression mechanism and said second compression mechanism are integrally formed, wherein a first discharge port of said first compression mechanism and a second discharge port of said second compression mechanism are connected to a single discharge path.

48. The hybrid compressor according to claim 47, wherein said first drive source comprises an internal combustion engine for driving a vehicle and an electric vehicle motor for driving said vehicle, wherein said internal combustion engine and said electric vehicle motor alternatively drive said first scroll-type compression mechanism, and said second drive source comprises an electric motor.

49. The hybrid compressor according to claim 47, wherein each of said first discharge port of said first compression mechanism and said second discharge port of said second compression mechanism is connected to said discharge path via a check valve.

50. The hybrid compressor according to claim 47, wherein a first fluid displacement of said first compression mechanism is greater than a second fluid displacement of said second compression mechanism.

51. The hybrid compressor according to claim 47, wherein said first compression mechanism and said second compression mechanism are driven selectively.

52. The hybrid compressor according to claim 47, wherein said first compression mechanism and said second compression mechanism are driven simultaneously.

* * * * *